US012023561B2

(12) United States Patent
Vogt et al.

(10) Patent No.: US 12,023,561 B2
(45) Date of Patent: Jul. 2, 2024

(54) GOLFER'S TOOL HOLDER

(71) Applicants: Robert Vogt, Waterloo (CA); Rachel Eby, Waterloo (CA)

(72) Inventors: Robert Vogt, Waterloo (CA); Rachel Eby, Waterloo (CA)

( * ) Notice: Subject to any disclaimer, the term of this patent is extended or adjusted under 35 U.S.C. 154(b) by 97 days.

(21) Appl. No.: 17/841,549

(22) Filed: Jun. 15, 2022

(65) Prior Publication Data

US 2023/0405424 A1 Dec. 21, 2023

(51) Int. Cl.
*A63B 57/20* (2015.01)
*A45F 5/02* (2006.01)

(52) U.S. Cl.
CPC ..... *A63B 57/20* (2015.10); *A45F 5/021* (2013.01)

(58) Field of Classification Search
CPC ..... A63B 57/20; A45F 5/021
USPC ..... 224/918
See application file for complete search history.

(56) References Cited

U.S. PATENT DOCUMENTS 2,665,830 A * 1/1954 Fowler ..... A63B 57/20 224/907
3,233,802 A * 2/1966 Ludwick ..... A63B 47/001 224/183
3,298,579 A * 1/1967 Smith ..... A45F 5/021 224/183
3,753,519 A * 8/1973 Gammon ..... A63B 57/00 206/579
4,730,728 A * 3/1988 Larkin ..... A63B 57/20 224/675
4,736,877 A * 4/1988 Clark ..... A63B 57/20 224/678
4,850,483 A * 7/1989 Stack ..... A63B 55/20 206/315.9
4,927,052 A * 5/1990 Marthaler ..... A63B 57/20 206/315.9
5,305,999 A * 4/1994 Tate ..... A63B 57/353 224/269
D349,550 S * 8/1994 Reeves ..... D3/254
5,423,530 A * 6/1995 Alvarez Gonzalez . A63B 57/20 224/678
5,494,202 A * 2/1996 Wyatt ..... A63B 57/20 224/919
D374,472 S * 10/1996 Nowak ..... D3/224
5,799,853 A * 9/1998 Brewster ..... A63B 57/207 224/679
D405,860 S * 2/1999 Hargrove ..... D21/796
5,934,530 A * 8/1999 Antczak ..... A63B 55/408 224/678
D414,538 S * 9/1999 Harrison ..... D21/796
6,168,061 B1 * 1/2001 Harrison ..... A63B 47/001 224/919
D448,555 S * 10/2001 deLong ..... D3/221
D503,449 S * 3/2005 Dastice ..... D6/552
(Continued)

*Primary Examiner* — Peter N Helvey
(74) *Attorney, Agent, or Firm* — CAPEHART LAW FIRM

(57) ABSTRACT

A golf tool holder is disclosed herein. The golf tool holder includes a housing and a fastener, such as a clip, configured to fasten the golf tool holder to a waistband or a belt of a golfer. The golf tool holder includes a divot repair tool holder, at least one tee holder, a golf ball holder and a ball marker holder. As such, the golf tool holder holds essential golf tools in specific places, thereby providing the golfer with easy access to the essential tools during golf play and allowing the golfer to remain focused on the golf game.

18 Claims, 12 Drawing Sheets

(56) References Cited

U.S. PATENT DOCUMENTS

D504,483 S * 4/2005 Leung ..... D3/221
6,889,828 B2 * 5/2005 Pursely ..... A63B 57/203 206/315.1
D514,647 S * 2/2006 Mora ..... D21/796
7,766,769 B2 * 8/2010 Lueders ..... A63B 57/50 224/666
8,573,457 B1 * 11/2013 Morgan ..... A45F 5/021 224/919
8,882,605 B1 * 11/2014 Lee ..... A63B 57/207 224/901.2
10,709,228 B2 * 7/2020 McLaughlin ..... A63B 57/20
2002/0162866 A1 * 11/2002 Hurtgam ..... A45F 5/00 224/684
2003/0006154 A1 * 1/2003 Chen ..... A63B 47/001 206/315.9
2003/0010796 A1 * 1/2003 Hurtgam ..... A45F 5/021 224/269
2004/0084495 A1 * 5/2004 Rudeen ..... A63B 47/001 224/684
2008/0230435 A1 * 9/2008 Cope ..... A63B 57/20 224/245
2009/0032419 A1 * 2/2009 Kealy ..... A63B 47/00 206/315.9
2009/0209369 A1 * 8/2009 Smith ..... A63B 57/10 224/183
2009/0302083 A1 * 12/2009 Eisele ..... A63B 57/203 224/684
2012/0012624 A1 * 1/2012 Marrero ..... A63B 57/203 224/660
2014/0124549 A1 * 5/2014 Zarbo ..... A63B 57/0032 224/163
2015/0306467 A1 * 10/2015 Hauge ..... A63B 57/207 224/269
2016/0082327 A1 * 3/2016 VanNatten ..... A63B 57/203 224/195
2023/0380558 A1 * 11/2023 Park ..... A61L 2/26

* cited by examiner

GOLFER'S TOOL HOLDER

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of golf accessories of existing art and more specifically relates to a golf tool holder.

RELATED ART

Golf is a sport that has been enjoyed for hundreds of years throughout the world. It employs the use of golf clubs used to strike a golf ball and the aim of the game is to get the golf ball into a hole in as little 'strokes' as possible. It is generally necessary for the golfer to carry many tools and accessories to aid in the golf play. For example, along with clubs, balls and tees, the golfer will typically also carry a divot repair tool to repair any divots in a golf green; and a ball marker to permit the golfer to temporarily remove their ball from the green, enabling other players to putt unobstructed. These tools are typically stored in golf bags and/or in the pockets of the golfer. However, golf is a hugely mental game requiring a great deal of focus, and to have to spend time and energy searching through pockets or golf bags for the tools can be extremely distracting and time consuming for not only the golfer themselves, but for other golfers. As such, a suitable solution is desired.

SUMMARY OF THE INVENTION

In view of the foregoing disadvantages inherent in the known golf accessory art, the present disclosure provides a novel golf tool holder. The general purpose of the present disclosure, which will be described subsequently in greater detail, is to provide a lightweight device that enables a golfer to organize and carry their golf essentials on the golf course, allowing easy access to the golf essentials during golf play.

A golf tool holder is disclosed herein. The golf tool holder includes a housing and a fastener. The housing may include a front side opposite a rear side, a left side opposite a right side, and a top side opposite a bottom side. The fastener may be attached to the rear side of the housing and configured to fasten the golf tool holder about a waist of a golfer. A plurality of golf tool holders may be disposed about the housing. Particularly, a divot repair tool holder may be disposed within one of the left side or the right side and configured to receive a divot repair tool; at least one tee holder may be disposed within another one of the left side or the right side and configured to receive at least one tee; a golf ball holder may be disposed within the front side and configured to receive a golf ball; and a ball marker holder may be disposed within the top side and configured to receive a ball marker.

For purposes of summarizing the invention, certain aspects, advantages, and novel features of the invention have been described herein. It is to be understood that not necessarily all such advantages may be achieved in accordance with any one particular embodiment of the invention.

Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, golfer's tool holder, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to golf accessories and more particularly to a golf tool holder. Generally, the golf tool holder may be a small, lightweight device that clips onto a belt or waistband of a golfer and holds essential golf tools in specific places, thereby enabling the golfer to carry the essential tools in an organized fashion such that they are easy to access during golf play. Particularly, the golf tool holder may carry a ball, one or more tees, a divot repair tool and a ball marker.

Figure 1:
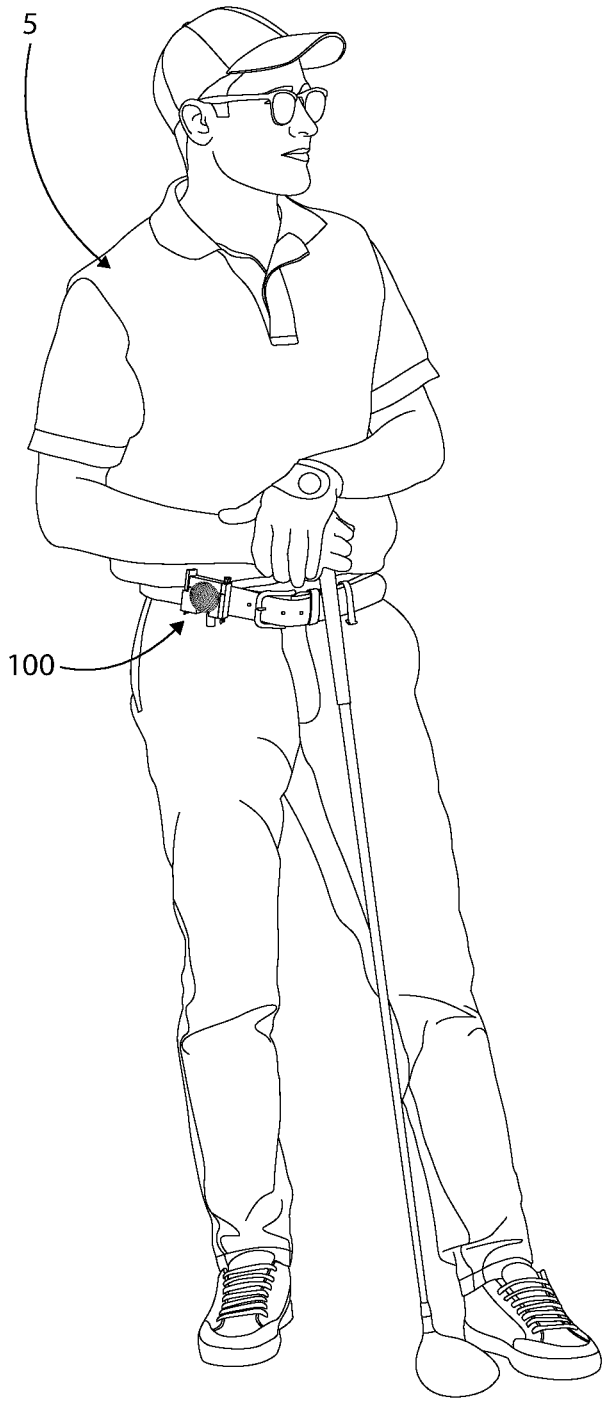
FIG. 1 is a front perspective view of a golf tool holder being worn about a waist of a golfer, according to an embodiment of the disclosure.

Referring now more specifically to the drawings by numerals of reference, there is shown in FIGS. 1-12, various views of a golf tool holder 100. As shown in these figures, the golf tool holder 100 may comprise a housing 110 and a fastener 120. The housing 110 may include a golf ball holder 130, a divot repair too holder 140, at least one tee holder 150 and a ball marker holder 160. As shown in FIG. 1 particularly, the fastener 120 may be configured to fasten the golf tool holder 100 about a waist of a golfer 5. For example, the fastener 120 may be fasten the golf tool holder 100 to a waistband or a belt of the golfer 5. It should however be appreciated that the fastener 120 is not limited to fastening about the waist of the golfer 5 nor is it limited to being fastened to the golfer 5 at all. For example, the fastener 120 may fasten the golf tool holder 100 to a pocket of the golfer 5, may fasten to a golf bag, etc.

As shown in FIGS. 2-12, the housing 110 may include a front side 111 opposite a rear side 112, a left side 113 opposite a right side 114 and a top side 115 opposite a bottom side 116. In some embodiments, the housing 110 may preferably be substantially rigid whilst being sufficiently lightweight so as to not inhibit golf swing. For example, the housing 110 may be made from a plastic material. It should however be appreciated that the housing 110 is not limited to a plastic material. For example, the housing 110 may include (but is not limited to) bamboo material, aluminum material, etc.

Figure 2:
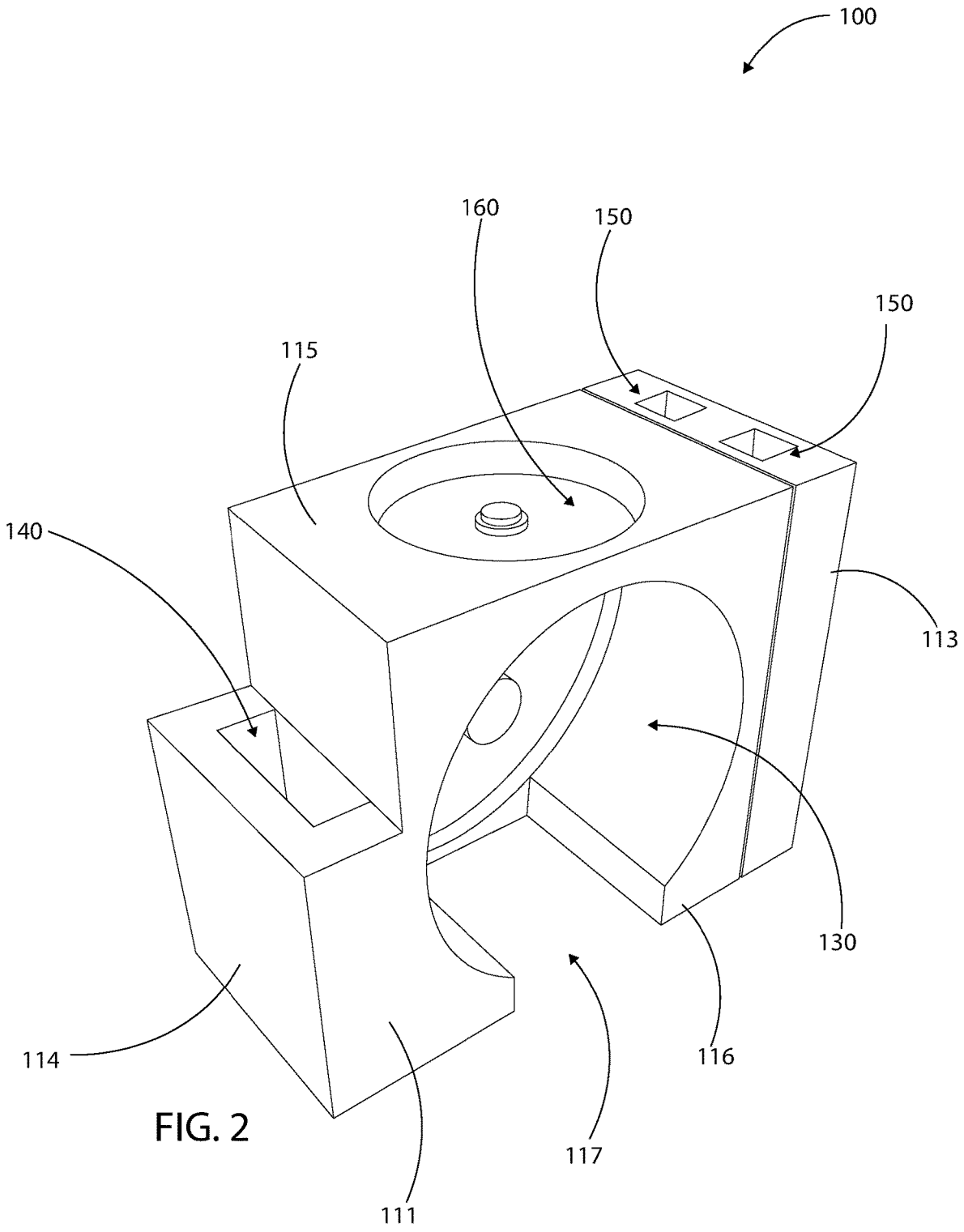
FIG. 2 is a front perspective view of the golf tool holder including a golf ball holder, a divot repair tool holder, two tee holders and a ball marker holder, according to an embodiment of the disclosure.
Figure 3:
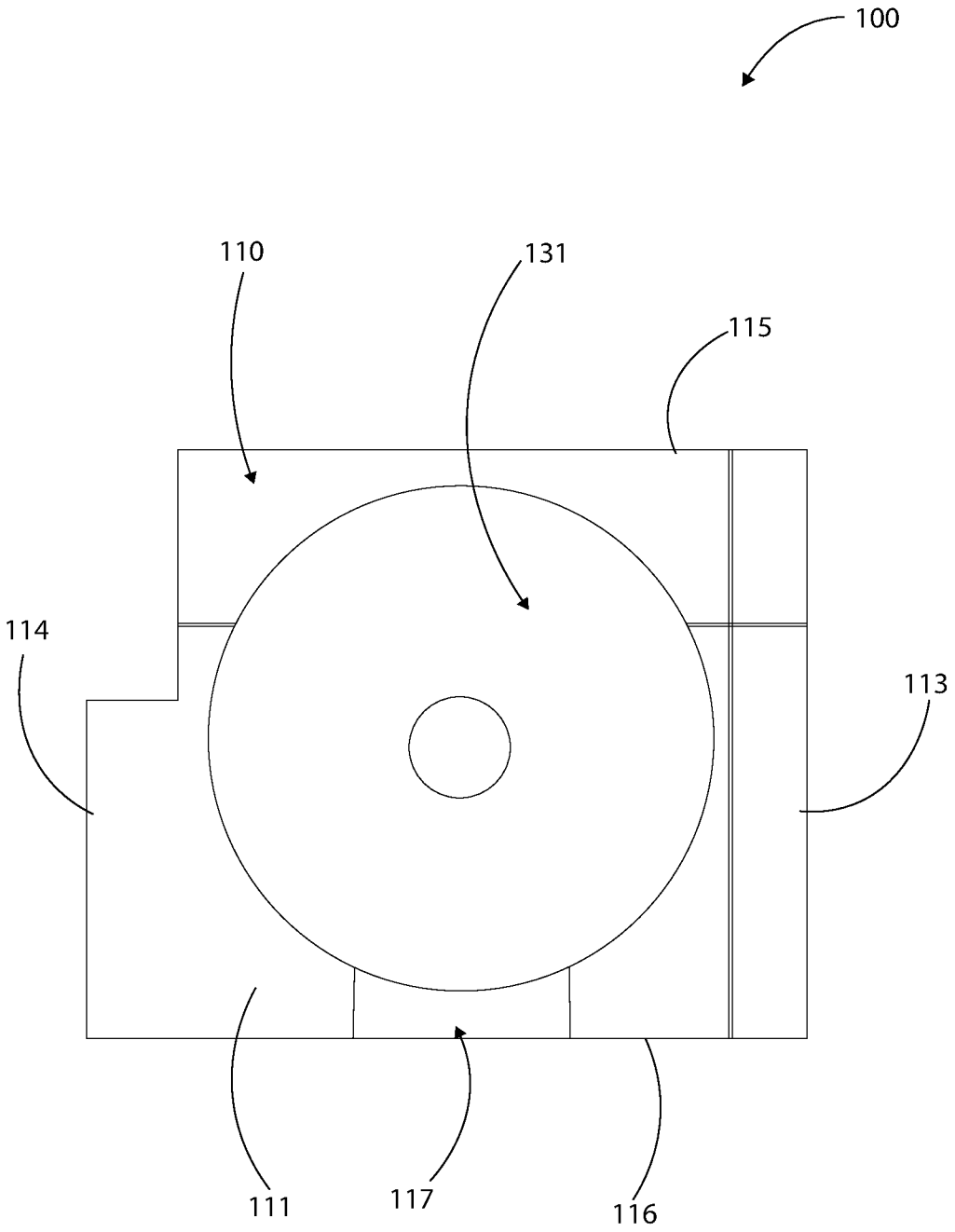
FIG. 3 is a front view of the golf tool holder, according to an embodiment of the disclosure.
Figure 4:
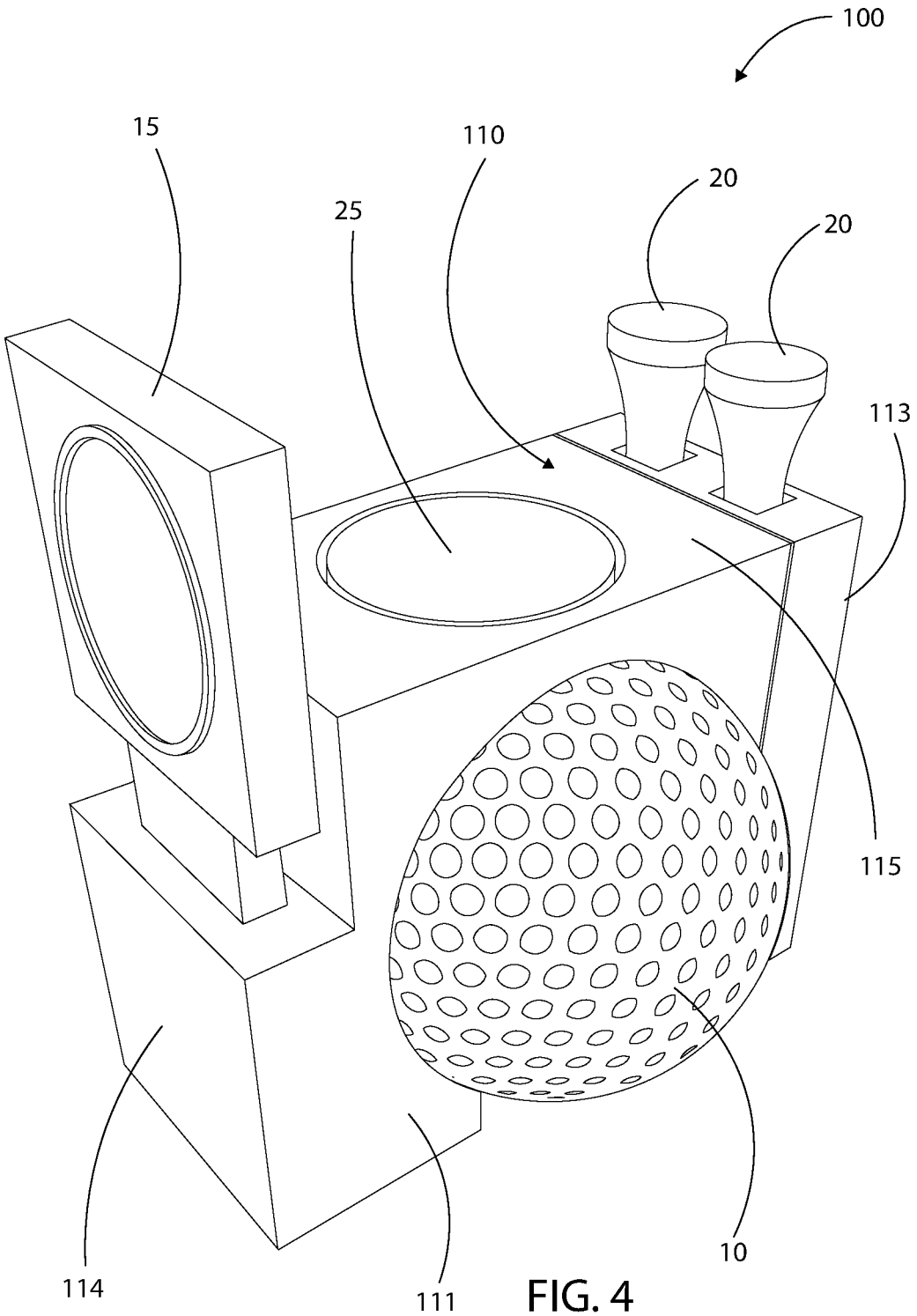
FIG. 4 is a front perspective view of the golf tool holder illustrating tools being held therewithin, particularly a golf ball, a divot repair tool, two tees, and a ball marker, according to an embodiment of the disclosure.
Figure 5:
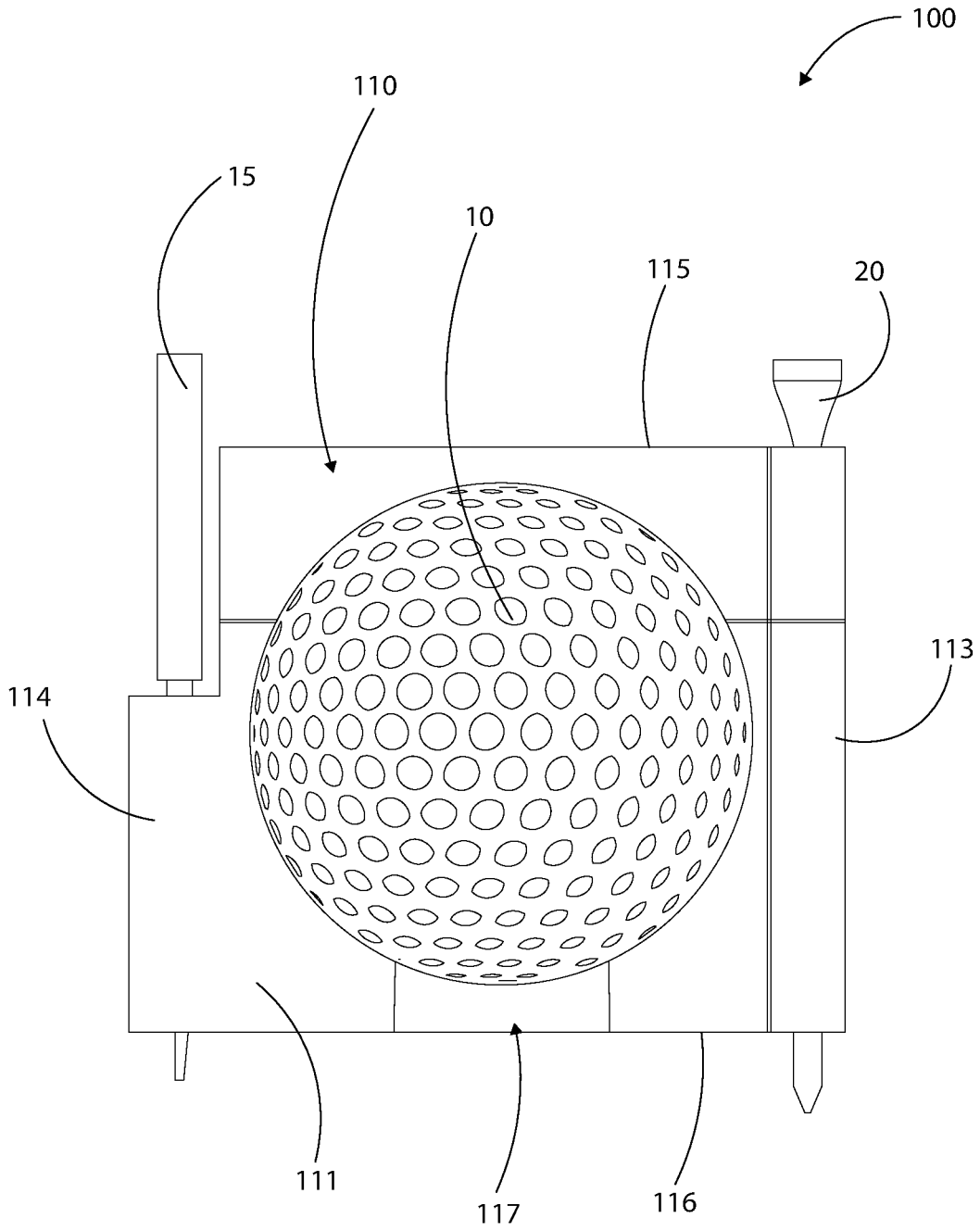
FIG. 5 is a front view of the golf tool holder, according to an embodiment of the disclosure.

The golf ball holder 130 may be disposed within the front side 111 of the housing 110 and configured to receive a golf ball 10. As shown in FIG. 2-3 particularly, the golf ball holder 130 may include a substantially spherical socket 131 (or half sphere) formed into the front side 111 of the housing 110 and including a diameter substantially equal to a diameter of the golf ball enabling the golf ball 10 to be held within the golf ball holder 130 via friction. As shown in FIG. 4-9, when held within the substantially spherical socket 131, a portion of the golf ball 10 may extend through the front side 111 of the housing 110. This, along with an opening 117 disposed on the bottom side 116 of the housing 110 and extending into the substantially spherical socket 131 (as shown particularly in FIGS. 2-3 and FIG. 6), may facilitate removal of the golf ball from the substantially spherical socket 131. For example, the golfer 5 may grasp the portions of the golf ball 10 that are exposed (i.e., front and bottom) and pull to remove.

In other embodiments, the substantially spherical socket 131 may include a spring assembly (not illustrated) that holds the golf ball 10 within the substantially spherical socket 131 via tension. The spring assembly may be in communication with a button (not illustrated) located on an exterior of the housing 110 such that it is manipulable by the golfer 5. As such, when the button is pressed by the golfer 5, the golf ball 10 may be ejected out of the substantially spherical socket 131 and into a hand of the golfer 5.

The divot repair tool holder 140 may be disposed within one of the left side 113 or the right side 114 of the housing 110 and configured to hold a divot repair tool 15. For example, as demonstrated by these figures, the divot repair tool holder 140 may located on the right side 114 of the housing 110 (relative to the golfer 5—the right side 114 of the housing 110 closest to the golfer 5's right side 114 when the golf tool holder 100 is attached about the waist of the golfer 5).

As shown in FIGS. 4-8, in some embodiments, the divot repair tool holder 140 may include a first slot 141. The first slot 141 may hold the divot repair tool 15 substantially vertically within the housing 110. Further, the first slot 141 may be of a size sufficient to receive a head 16 of the divot repair tool 15. Additionally, as shown, the first slot 141 may include (but is not limited to) a substantially rectangular cross-section.

Figure 6:
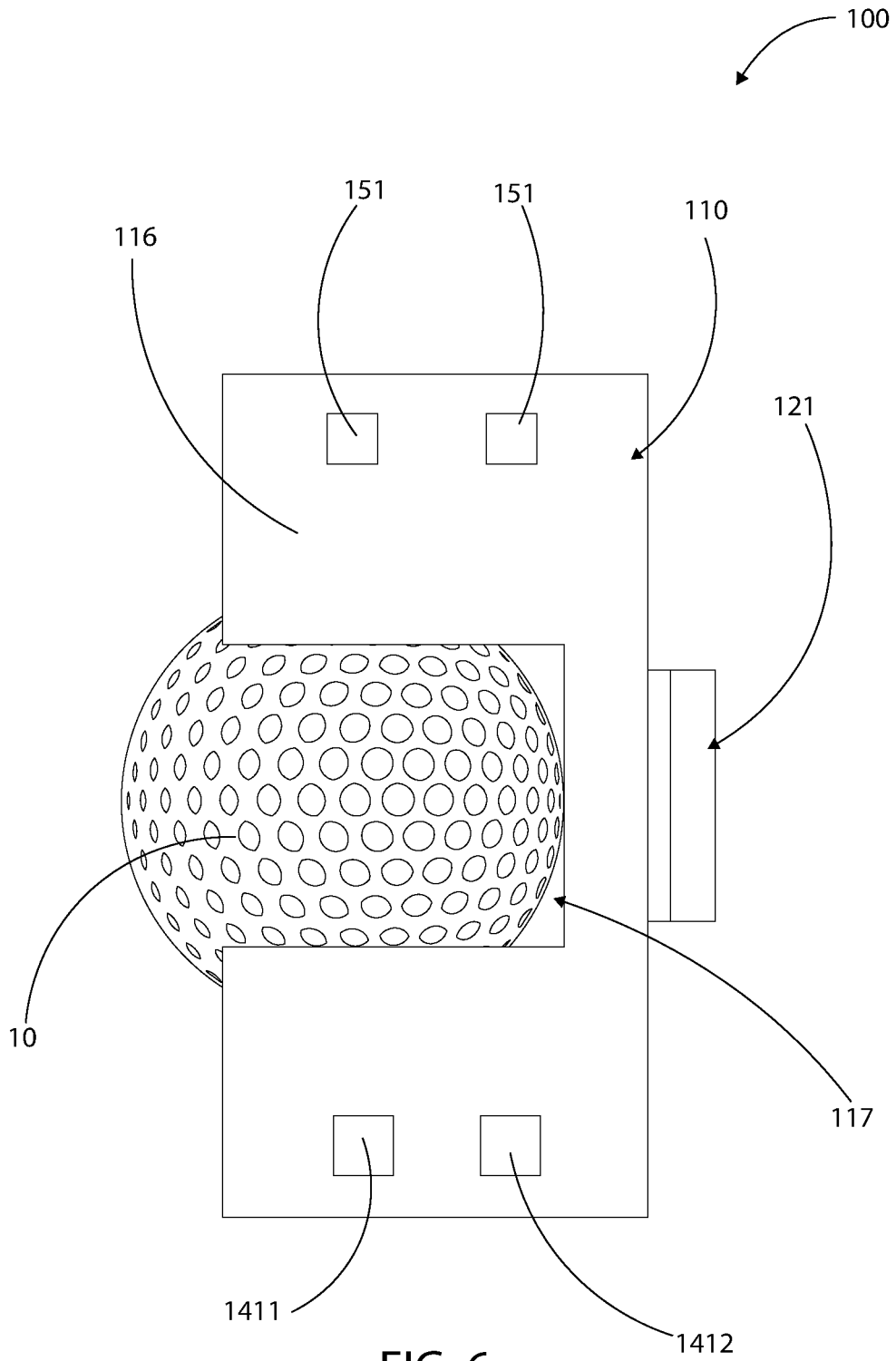
FIG. 6 is a bottom view of the golf tool holder, according to an embodiment of the disclosure.

In some embodiments, the first slot 141 may extend from the top side 115 of the housing 110 through to the bottom side 116 of the housing 110 on the one of the left side 113 or the right side 114 thereof (i.e., the right side 114). Particularly, as shown in FIG. 6, at the bottom side 116 of the housing 110, the first slot 141 may be split into two first slots 1411, 1412 each configured to receive a leg 17 of the divot repair tool 15. This may securely fasten the divot repair tool 15 within the divot repair tool holder 140, ensuring that the divot repair tool 15 does not fall out during golf play. As shown in FIG. 6, the two first slots 1411, 1412 may include (but are not limited to) a square cross-section.

In some embodiments, the divot repair tool holder 140 may be sized to hold a variety of differently sized and shaped divot repair tools. In additional embodiments, the divot repair tool 15 may be provided with the golf tool holder 100, as demonstrated in these figures. As such, the first slot(s) 141, 1411, 1412 may be sized to specifically accommodate the divot repair tool 15 provided.

The at least one tee holder 150 may be disposed within another one of the left side 113 or the right side 114 of the housing 110 and configured to receive at least one tee 20. Particularly, as shown in these figures, the at least one tee holder 150 may be located on the left side 113 of the housing 110 (the left side 113 thereby being closest to the golfer 5's left side when the golf tool holder 100 is attached about the waist of the golfer 5). The at least one tee holder 150 may include a second slot 151 configured to hold the at least one tee 20 substantially vertically within the housing 110. Similar to the first slot 141, the second slot 151 may extend from the top side 115 of the housing 110 through to the bottom side 116 of the housing 110 (FIG. 6). Again, this may securely fasten the at least one tee 20 within the at least one tee holder 150 during golf play.

Preferably, as shown in these figures, the at least one tee holder 150 may include two tee holders 150. As such, two second slots 151 may be provided on the top side 115 of the housing 110 and extend through to the bottom side 116 of the housing 110, thereby enabling the golf tool holder 100 to hold two tees 20 therein. Further, as shown, the two second slots 151 may each include (but are not limited to) a square cross-section.

It should be appreciated that the divot repair tool holder 140 and the tee holders 150 are not limited to being used solely for holding the divot repair tool 15 and tees 20 (respectively). For example, the divot repair tool holder 140 and/or the tee holders 150 may be used for holding pencil(s).

Figure 7:
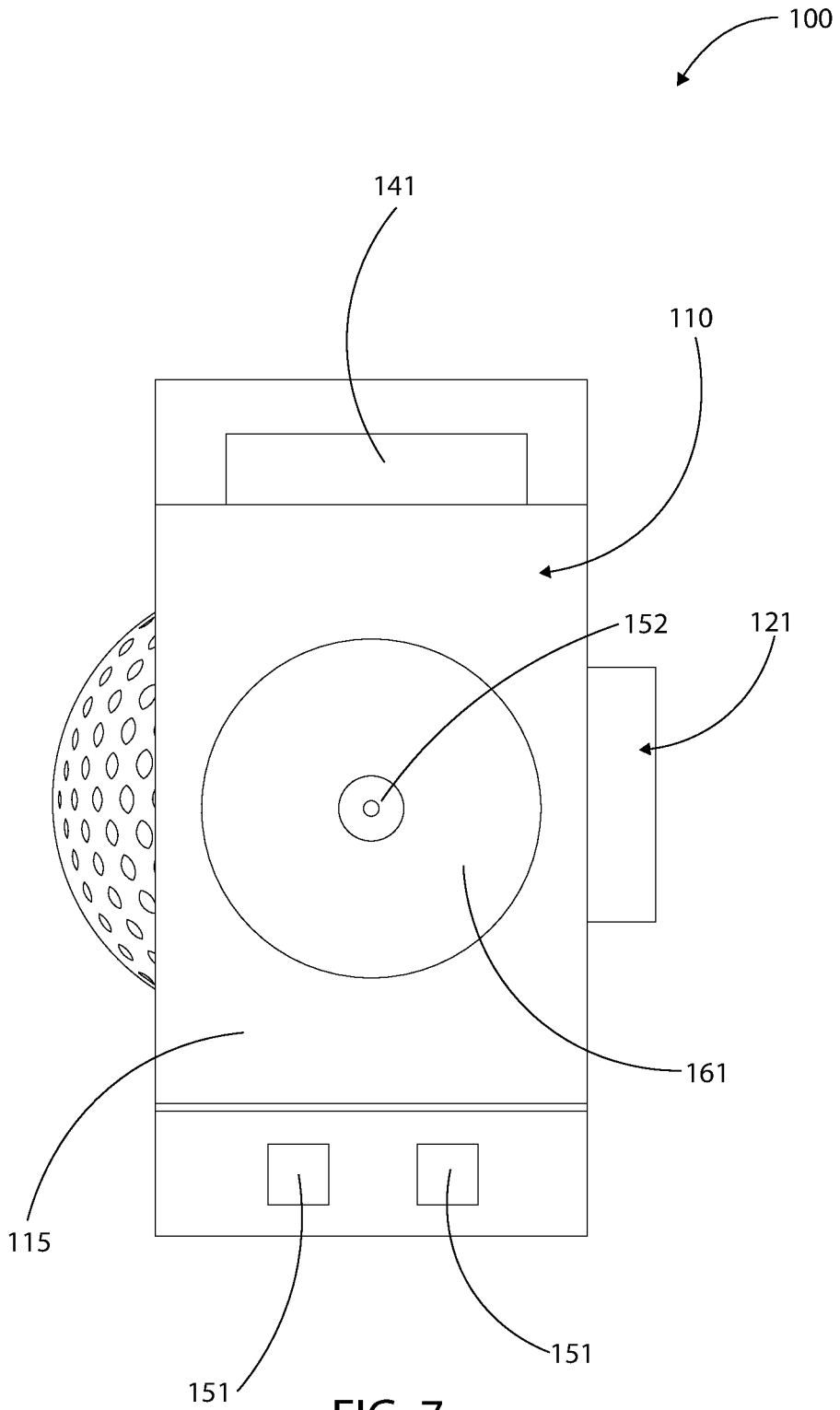
FIG. 7 is a top view of the golf tool holder with the ball marker removed from the ball marker holder, according to an embodiment of the disclosure.
Figure 8:
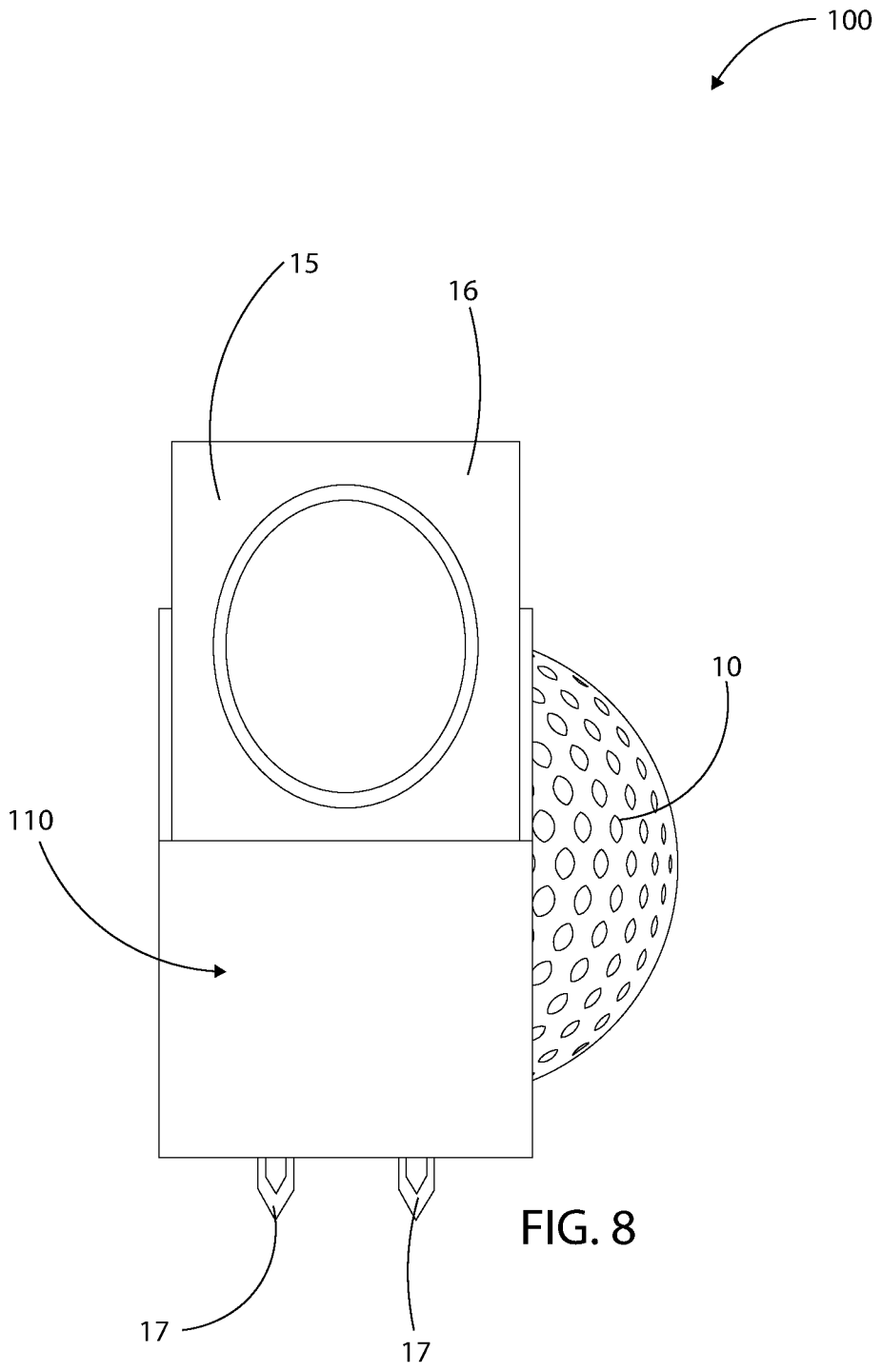
FIG. 8 is a side view of the golf tool holder illustrating the divot repair tool within the divot repair tool holder, according to an embodiment of the disclosure.
Figure 9:
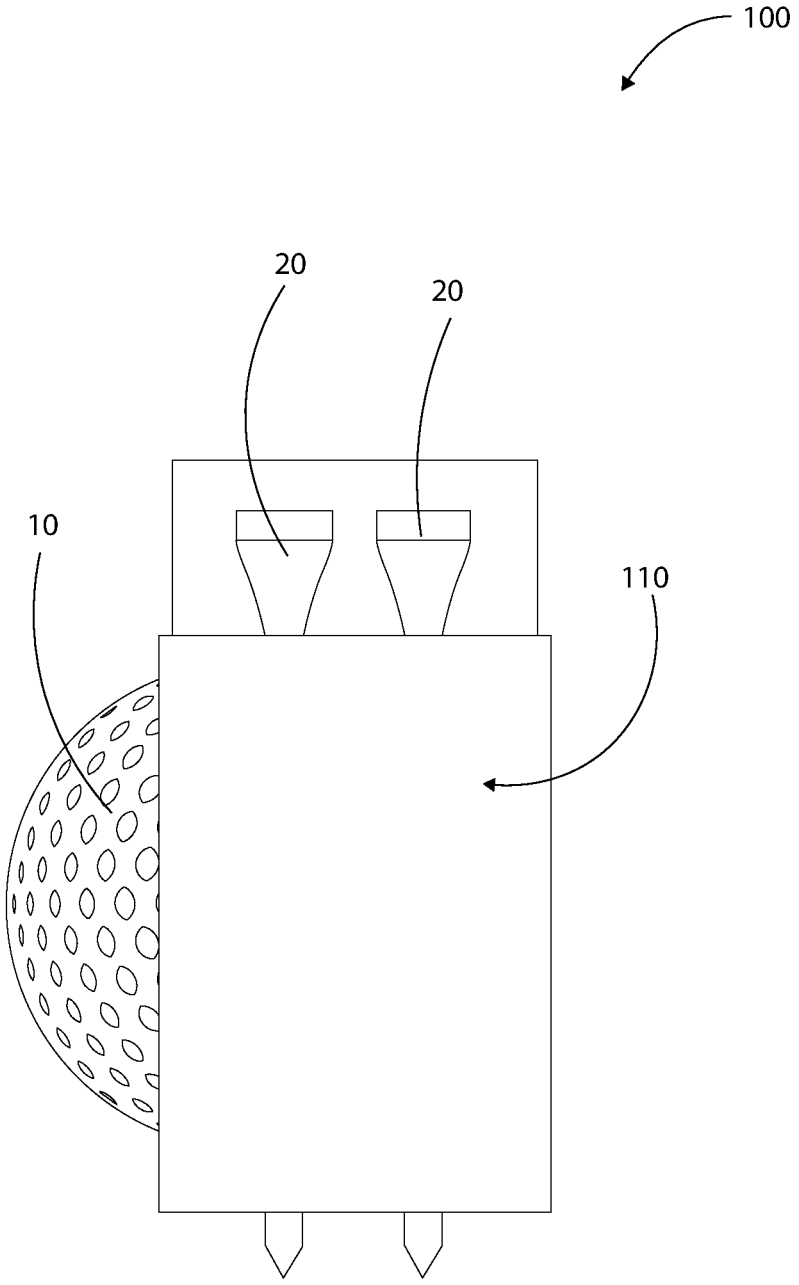
FIG. 9 is a side view of the golf tool holder illustrating the two tees within the divot two tee holders, according to an embodiment of the disclosure.
Figure 10:
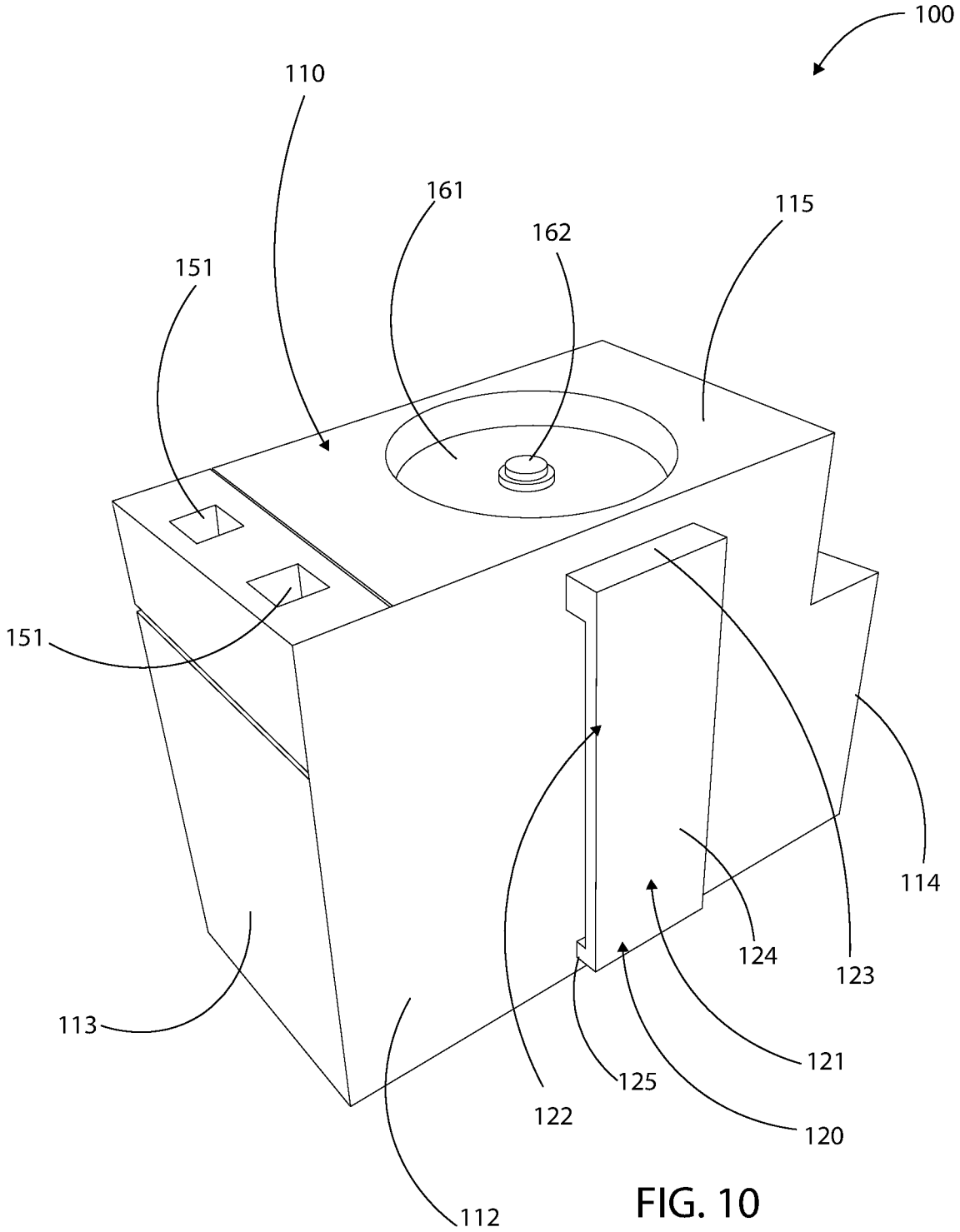
FIG. 10 is a rear perspective view of the golf tool holder illustrating a fastener, according to an embodiment of the disclosure.

Further, the ball marker holder 160 may be disposed within the top side 115 and configured to receive a ball marker 25. Particularly, the ball marker holder 160 may include a (substantially) circular recess 161, as shown in FIG. 2 and FIG. 7 and FIG. 10. The circular recess 161 may include a shape and size similar to the ball marker 25; however, the circular recess 161 may include a diameter slightly larger than the ball marker 25, to enable the golfer 5 to grip the ball marker 25 to remove it from the circular recess 161. To secure the ball marker 25 within the ball marker holder 160, the circular recess 161 may include a magnetic material 162 disposed about a bottom surface 163 thereof, as particularly shown in FIG. 7 and FIG. 10; and as such, the ball marker 25 may be held within the ball marker holder 160 via magnetic attraction.

Figure 11:
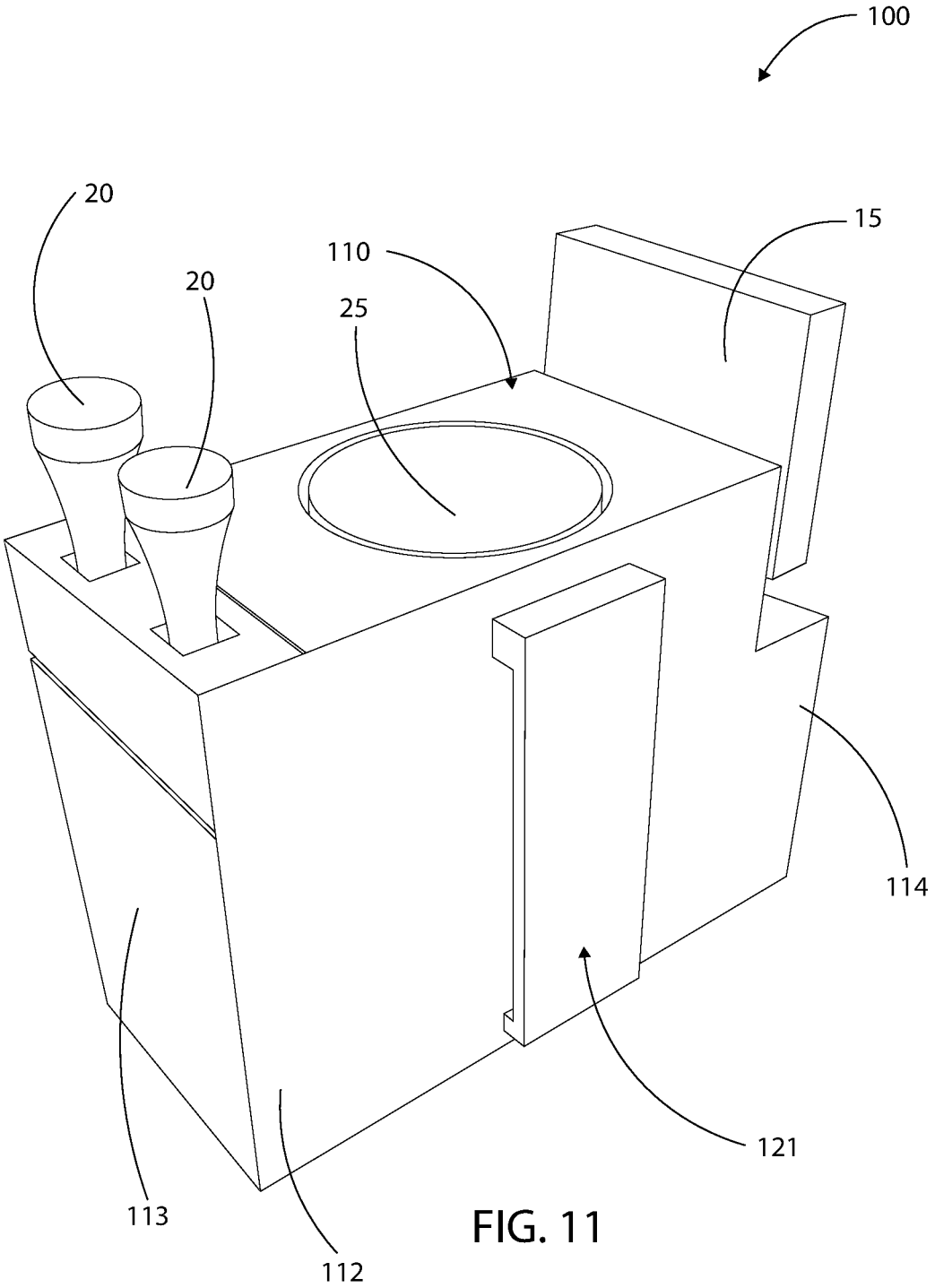
FIG. 11 is a rear perspective view of the golf tool holder, according to an embodiment of the disclosure.
Figure 12:
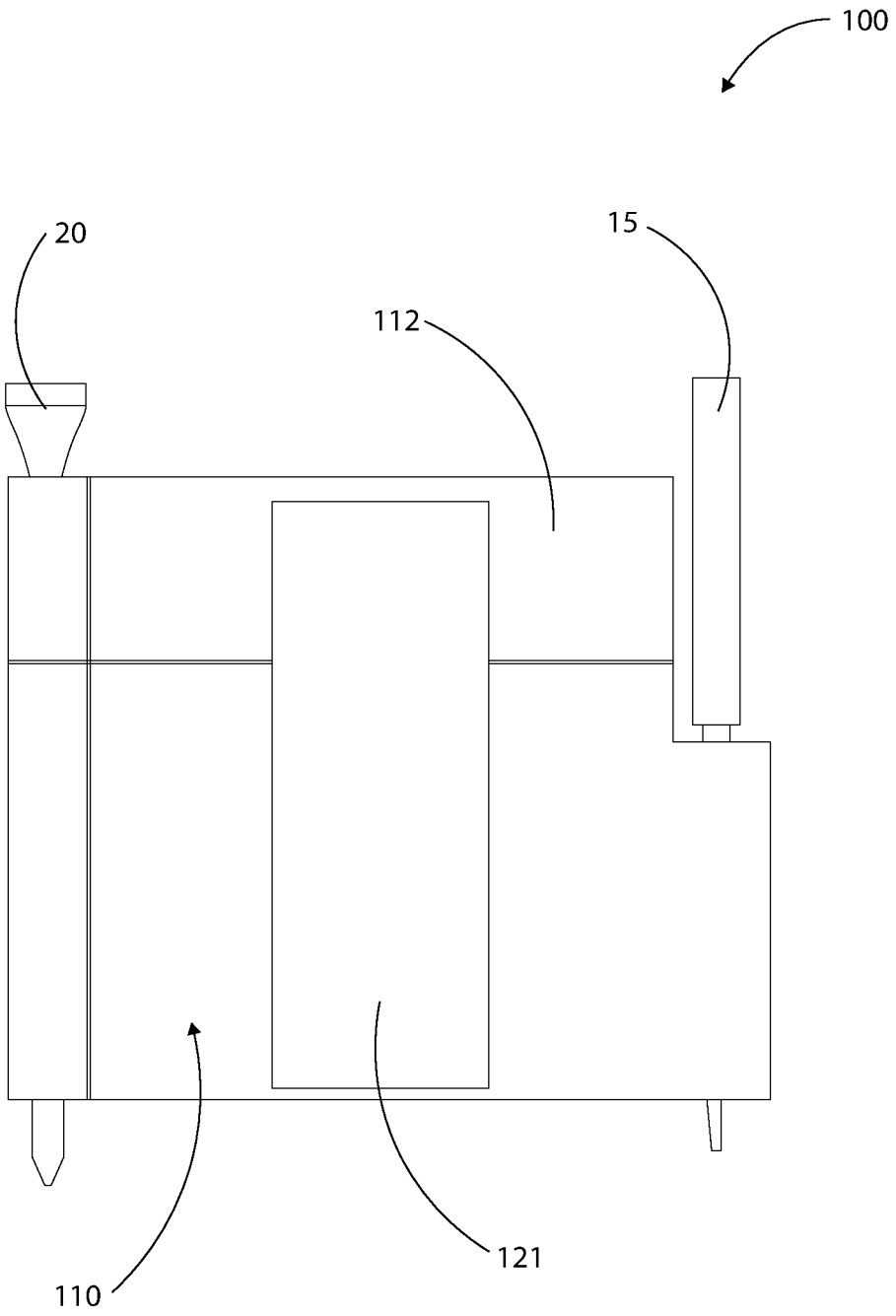
FIG. 12 is a rear view of the golf tool holder, according to an embodiment of the disclosure.

As shown in FIGS. 10-12, the fastener 120 may be attached to the rear side 112 of the housing 110. Preferably, the fastener 120 may include a clip 121. As shown particularly in FIG. 2, the clip 121 may include an arm 122 having a horizontal portion 123 and a vertical portion 124 extending downwardly and (at least substantially) perpendicularly from the horizontal portion 123. As shown, the horizontal portion 123 may be attached to the rear side 112 of the housing 110 and the vertical portion 124 and the rear side 112 of the housing 110 may together define a space therebetween for receiving a surface, such as the waistband or belt of the golfer 5, as discussed above.

The vertical portion 124 may be at least partially flexible to enable the clip 121 to fasten to surfaces of various thicknesses. Further, as shown in FIG. 10, in some embodiments, a bottom of the vertical portion 124 may include a lip 125 extending forwardly therefrom (toward the rear side 112 of the housing 110). This lip 125 may enable the clip 121 to better latch to the surface and prevent the golf tool holder 100 from falling off, particularly when clipped to the waist of the golfer 5 during swings.

In using the golf tool holder 100, the golfer 5 may insert the golf ball 10, the divot repair tool 15, one or two tees 20, and the ball marker 25 into their respective holders (130, 140, 150, 160). The golfer 5 may then attach the golf tool holder 100 to their waist, such as to their waistband or belt, via the fastener 120. Preferably, the golfer 5 positions the golf tool holder 100 such that it does not inhibit their golf swing. The golf ball 10, the divot repair tool 15, the tees 20, and the ball marker 25 are then readily accessed by the golfer 5 during golf play.

It should be noted that certain steps are optional and may not be implemented in all cases. It should also be noted that the steps described above can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for using a golf tool holder are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A golf tool holder comprising:

a rectangular housing including a front side opposite a rear side, a left side opposite a right side, a top side opposite a bottom side, all defining an interior, a divot repair tool holder disposed within one of the left side and the right side and configured to receive a divot repair tool, at least one tee holder disposed within another one of the left side and the right side and configured to receive at least one tee, a golf ball holder disposed within the interior of the housing having access thereto from the front side, the golf ball holder includes a substantially spherical socket, the substantially spherical socket including a diameter substantially equal to a diameter of the golf ball and configured to receive a golf ball that when the golf ball is held by the substantially spherical socket a portion of the golf ball extend through the front side of the housing, the bottom side of the housing includes an opening extending into the substantially spherical socket and to the front side of the housing, and wherein the opening facilitates removal of the golf ball from the substantially spherical socket, and a ball marker holder disposed within the top side and configured to receive a ball marker; and a fastener attached to the rear side of the housing and configured to fasten the golf tool holder about a waist of a golfer.

2. The golf tool holder of claim 1, wherein the housing is substantially rigid.

3. The golf tool holder of claim 1, wherein the golf ball is held within the golf ball holder via friction.

4. The golf tool holder of claim 1, wherein the divot repair tool holder includes a first slot configured to hold the divot repair tool substantially vertically within the housing.

5. The golf tool holder of claim 4, wherein the first slot extends from the top side of the housing through to the bottom side of the housing on the one of the left side and the right side thereof.

6. The golf tool holder of claim 5, wherein the at least one tee holder includes a second slot configured to hold the at least one tee substantially vertically within the housing.

7. The golf tool holder of claim 6, wherein the second slot extends from the top side of the housing through to the bottom side of the housing on the another one of the left side and the right side thereof.

8. The golf tool holder of claim 1, wherein the ball marker holder includes a substantially circular recess.

9. The golf tool holder of claim 8, wherein the substantially circular recess includes a magnetic material disposed about a bottom surface thereof, and wherein the ball marker is held within the ball marker holder via magnetic attraction.

10. The golf tool holder of claim 1, wherein the fastener includes a clip, the clip including an arm having a horizontal portion and a vertical portion extending downwardly and at least substantially perpendicularly from the horizontal portion, the vertical portion being at least partially flexible, the horizontal portion being attached to the rear side of the housing, the vertical portion and the rear side of the housing together defining a space therebetween.

11. A golf tool holder comprising:

a substantially rigid rectangular housing including a front side opposite a rear side, a left side opposite a right side, a top side opposite a bottom side, all defining an interior, the housing further having:

a divot repair tool holder disposed within one of the left side and the right side, the divot repair tool including a first slot configured to receive and hold a divot repair tool substantially vertically within the housing;

at least one tee holder disposed within another one of the left side and the right side, the at least one tee holder including a second slot configured to receive and hold at least one tee substantially vertically within the housing;

a golf ball holder disposed within the interior of the housing having access thereto from the front side, the golf ball holder including a substantially spherical socket, the substantially spherical socket including a diameter substantially equal to a diameter of the golf ball and configured to receive a golf ball that when the golf ball is held by the substantially spherical socket a portion of the golf ball extend through the front side of the housing, the bottom side of the housing includes an opening extending into the substantially spherical socket and to the front side of the housing, and wherein the opening facilitates removal of the golf ball from the substantially spherical socket; and a ball marker holder disposed within the top side, the ball marker holder including a substantially circular recess, the ball marker holder configured to receive and hold a ball marker therein; and a fastener attached to the rear side of the housing and configured to fasten the golf tool holder about a waist of a golfer.

12. The golf tool holder of claim 11, wherein the golf ball is held within the golf ball holder via friction.

13. The golf tool holder of claim 11, wherein the first slot extends from the top side of the housing through to the bottom side of the housing on the one of the left side and the right side thereof.

14. The golf tool holder of claim 13, wherein the second slot extends from the top side of the housing through to the bottom side of the housing on the another one of the left side and the right side thereof.

15. The golf tool holder of claim 11, wherein the substantially circular recess includes a magnetic material disposed about a bottom surface thereof, and wherein the ball marker is held within the ball marker holder via magnetic attraction.

16. The golf tool holder of claim 11, wherein the fastener includes a clip, the clip including an arm having a horizontal portion and a vertical portion extending downwardly and at least substantially perpendicularly from the horizontal portion, the vertical portion being at least partially flexible, the horizontal portion being attached to the rear side of the housing, the vertical portion and the rear side of the housing together defining a space therebetween.

17. A golf tool holder comprising:

a substantially rigid housing including a front side opposite a rear side, a left side opposite a right side, a top side opposite a bottom side, the housing further having:

a divot repair tool holder disposed within one of the left side and the right side, the divot repair tool including a first slot configured to receive and hold a divot repair tool substantially vertically within the housing, the first slot extending from the top side of the housing through to the bottom side of the housing on the one of the left side and the right side thereof;

at least one tee holder disposed within another one of the left side and the right side, the at least one tee holder including a second slot configured to receive and hold at least one tee substantially vertically within the housing, the second slot extends from the top side of the housing through to the bottom side of the housing on the another one of the left side and the right side thereof;

a golf ball holder disposed within the front side, the golf ball holder including a substantially spherical socket formed into the front side, the substantially spherical socket including a diameter substantially equal to a diameter of the golf ball, the golf ball holder configured to receive and hold the golf ball therein via friction, wherein the bottom side of the housing includes an opening extending into the substantially spherical socket, and wherein the opening facilitates removal of the golf ball from the substantially spherical socket; and a ball marker holder disposed within the top side, the ball marker holder including a substantially circular recess, the ball marker holder configured to receive and hold a ball marker therein, the substantially circular recess including a magnetic material disposed about a bottom surface thereof and thereby, the ball marker is held within the ball marker holder via magnetic attraction; and a clip attached to the rear side of the housing and configured to fasten the golf tool holder about a waist of a golfer, the clip including an arm having a horizontal portion and a vertical portion extending downwardly and at least substantially perpendicularly from the horizontal portion, the vertical portion being at least partially flexible, the horizontal portion being attached to the rear side of the housing, the vertical portion and the rear side of the housing together defining a space therebetween.

18. The golf tool holder of claim 1, wherein the substantially spherical socket further comprises:

a spring assembly located within the substantially spherical socket, a button located on an exterior of the housing and in communication with the spring assembly and is manipulable by a user, wherein when the button is manipulated by the user the spring assembly is engaged such that the golf ball is ejected out of the substantially spherical socket.

* * * * *